US005769609A

United States Patent [19]

Plescher et al.

[11] Patent Number: 5,769,609

[45] Date of Patent: Jun. 23, 1998

[54] LIQUID RING COMPRESSOR HAVING A DISTRIBUTION GROOVE FOR SEALING

[75] Inventors: Goerg Plescher, Martinsheim; Bernhard Tews, Altdorf; Robert Siebenwurst, Nuremberg, all of Germany

[73] Assignee: Siemens Aktiengesellschaft, München, Germany

[21] Appl. No.: 696,671

[22] Filed: Aug. 14, 1996

[30] Foreign Application Priority Data

Aug. 16, 1995 [DE] Germany ..... 195 30 152.8

[51] Int. Cl.[6] ..... F04C 19/00

[52] U.S. Cl. ..... 417/68; 417/69

[58] Field of Search ..... 417/68, 69

[56] References Cited

U.S. PATENT DOCUMENTS 4,679,987 7/1987 Olsen ..... 417/68 X
4,755,107 7/1988 Trimborn ..... 417/68

FOREIGN PATENT DOCUMENTS 0071715 2/1983 European Pat. Off. ..... 417/68
1 027 358 4/1958 Germany .
587585 4/1947 United Kingdom ..... 417/68

*Primary Examiner*—Timothy Thorpe
*Assistant Examiner*—Cheryl J. Tyler
*Attorney, Agent, or Firm*—Kenyon & Kenyon

[57] ABSTRACT

A liquid-ring compressor having a rotor mounted in a compressor housing. The rotor is mounted eccentrically relative to the center axis of the compressor housing. At least one control disk is arranged on one of the end faces of the rotor. The control disk is provided with a suction slot and a pressure slot for the feed and discharge of the medium to be compressed, respectively. The control disk also has an encircling distribution groove in the area covered radially by the hub of the rotor. Operating liquid is introduced into a feed opening, which leads to the distribution groove, to seal an axial gap between the control disk and the rotor hub. A blocking element projects radially into the distribution groove and is provided on the side of the feed opening that has the greater pressure differential between the pressure of the operating liquid entering the feed opening and the pressure in the rotor cells. The blocking element improves the sealing of the axial gap.

9 Claims, 2 Drawing Sheets

LIQUID RING COMPRESSOR HAVING A DISTRIBUTION GROOVE FOR SEALING

FIELD OF THE INVENTION

The invention relates generally to liquid ring compressors. In particular, the invention relates to liquid ring compressors that have a rotor eccentrically mounted in the compressor housing and at least one control disk arranged at one end of the rotor. The control disk is provided with a suction slot and a pressure slot and a distribution groove. The distribution groove is located in the area of the hub of the rotor. A feed opening leads to the distribution groove, Operating liquid is introduced into the feed opening to seal an axial gap that exists between the control disk and the rotor hub.

BACKGROUND OF THE INVENTION

Liquid ring compressors are generally described in DE-B-027 358. In this compressor, an opening is provided directly after the pressure slot relative to the direction of rotation of the rotor. The opening is in fluid flow communication with a radial transverse groove formed in the control disk. The transverse groove leads into an inner and an outer encircling distribution groove. The liquid ring of the compressor covers the opening. Operating liquid is directed through the opening, into the transverse groove and subsequently into the distribution grooves. The operating liquid flows from the distribution grooves into an axial gap between the control disk and the rotor hub, thus sealing the axial gap. A pressure pattern that increases from the intake pressure to the compressor pressure develops across the periphery of the distribution groove. Therefore, the pressure difference between the feed pressure of the operating liquid and the pressure in the individual rotor cells is not constant. This consequently leads to more operating liquid being forced through the axial gap in areas of a greater pressure difference than in areas where the pressure difference is not so great. Thus, uniform sealing of the axial gap is not guaranteed.

It is an objective of this invention to provide a liquid-ring compressor that improves the sealing of the axial gap between the control disk and the rotor hub.

SUMMARY OF THE INVENTION

The objective is achieved by providing a blocking element that projects radially into the distribution groove on the side of the opening that has a greater pressure differential between the feed pressure of the operating liquid and the pressure in the rotor cells. A blocking element in the distribution groove prevents the operating liquid that seals the axial gap from flowing directly from the feed opening to the area of the greater pressure differential. Instead, by arranging the blocking element on the side of the feed opening having the greater differential, the operating liquid is directed to the area where the pressure difference between the feed pressure of the operating liquid and the pressure in the rotor cells is not as great. This arrangement provides a better overall distribution of the operating liquid sealing off the axial gap over the full periphery of the distribution groove.

Direct flow from the feed opening to the area of the greater pressure differential can be completely prevented if the blocking element extends over the full radial extent of the distribution groove.

Since the distribution groove directly encircles the rotor shaft, the radial length of the sealing section is maximized.

It is especially advantageous that the feed opening be provided in the area lying between the end of the suction slot and the start of the pressure slot relative to the direction of rotation of the rotor. This arrangement directs the flow of the operating liquid in the distribution groove in the same direction as the rotation of the rotor so that the operating liquid in the distribution groove is still entrained in the peripheral direction by the rotating rotor.

DETAILED DESCRIPTION

Figure 1:
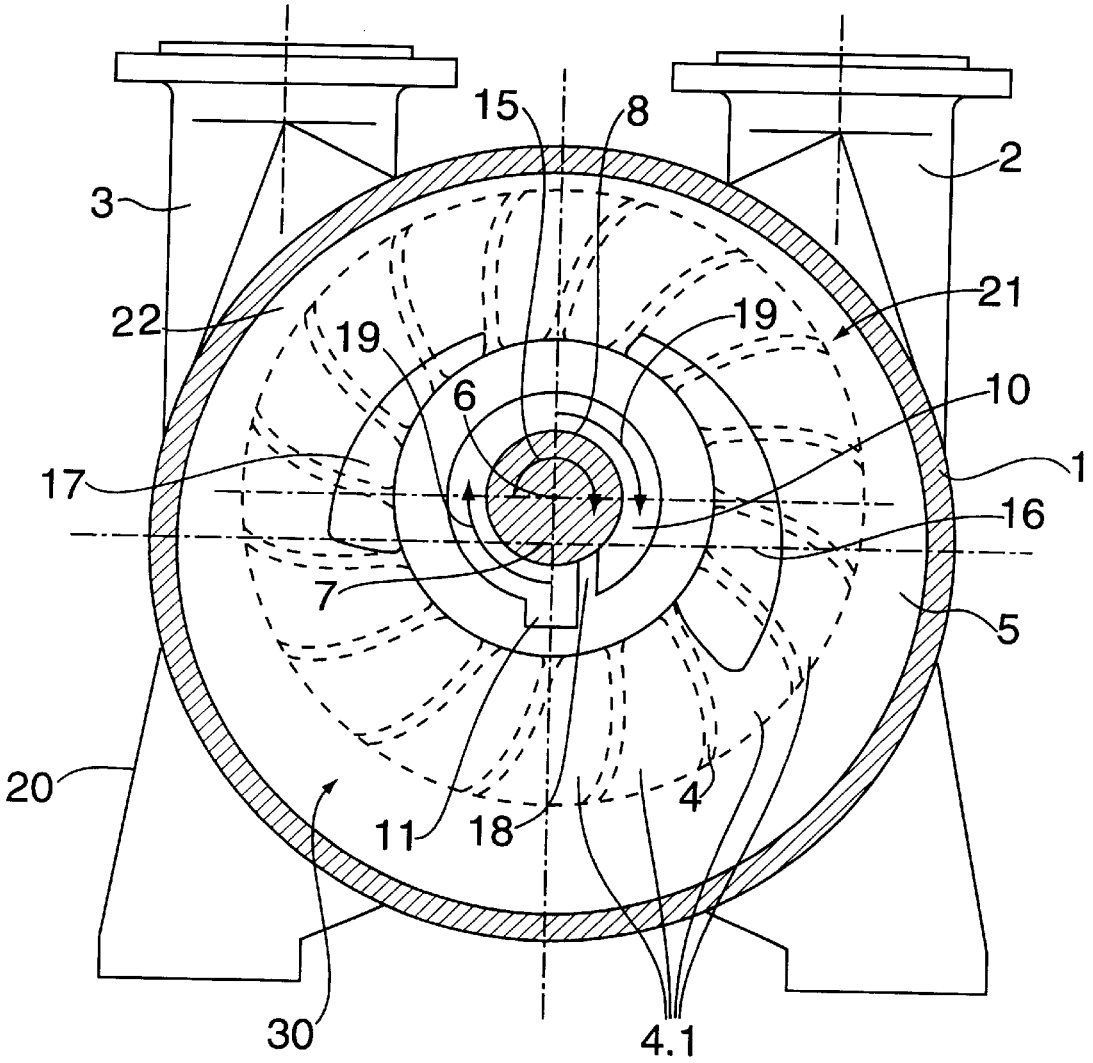
FIG. 1 is a partial cross-sectional view of a liquid ring compressor with a plan view of the control disk.

FIG. 1 illustrates a liquid ring compressor with compressor housing 1 which encloses a working chamber or working space 30. A side plate 20 is attached to the end of the housing, thereby delimiting the housing. The side plate 20 encloses a suction chamber 21 and a pressure chamber 22. An intake connection 2 leads to the suction chamber, and a pressure connection 3 connects to the pressure chamber of the side plate 20. Both the intake connection 2 and pressure connection 3 are provided on the housing 1. A control disk 5 separates the working space 30 containing the rotor 4 of the compressor from the suction and pressure chambers 21, 22 of the side plate 20. The control disk 5 is attached to the compressor housing 1. The rotor lying axially in front of the control disk 5 is indicated by broken lines in FIG. 1. The rotor 4 has a plurality of rotor cells 4.1 distributed therearound. The axis 6 of the rotor 4 is offset eccentrically from the center axis 7 of the compressor housing 1.

Figure 2:
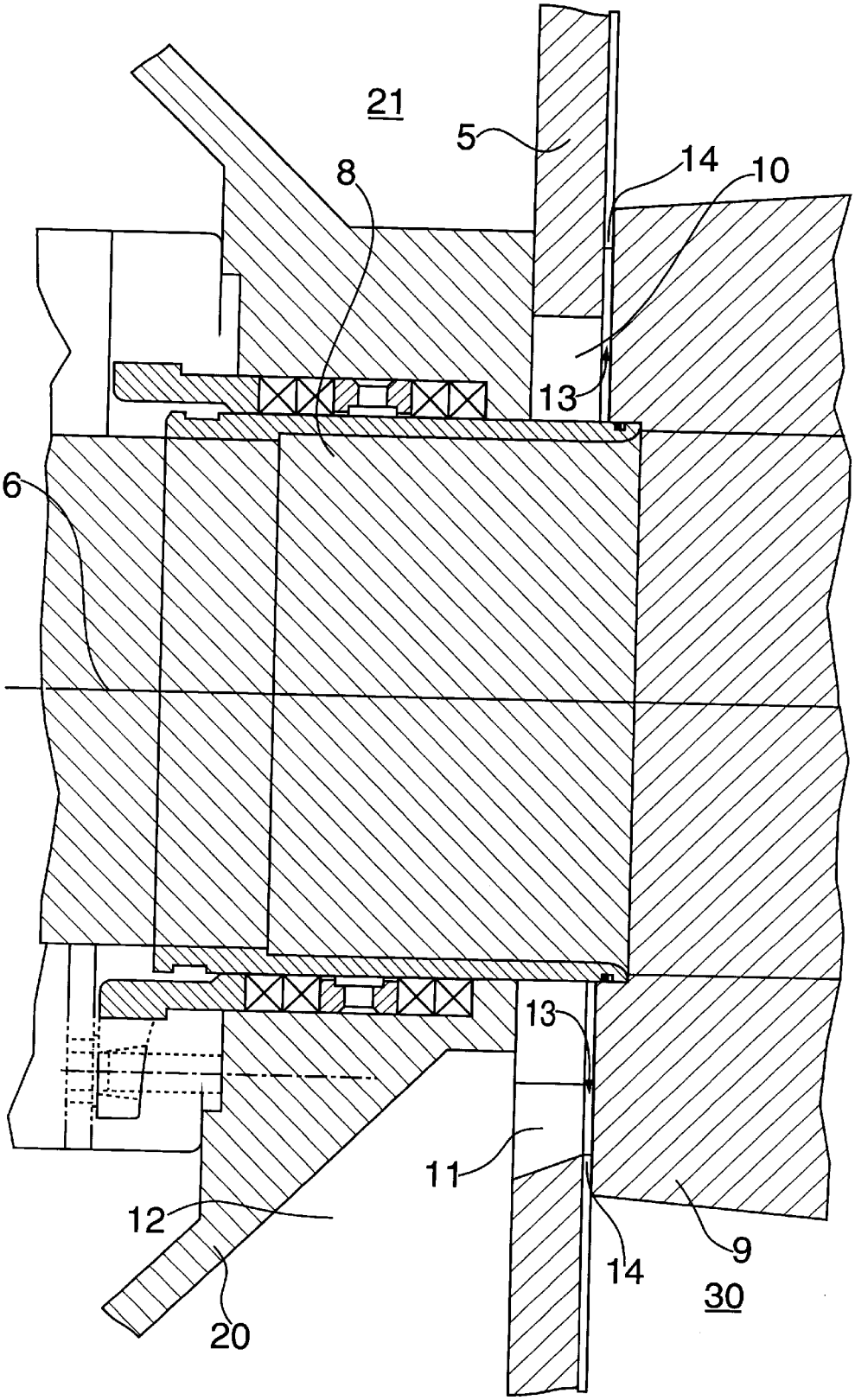
FIG. 2 is an enlarged representation of a partial longitudinal cross-section of a liquid-ring compressor in the area of the control disk.

A distribution groove 10 is formed in the control disk 5 and directly encircles the shaft 8 of the rotor 4 and opens toward the hub 9 of the rotor 4 (see FIG. 2). The distribution groove 10 extends over the full periphery of the rotor shaft 8 (subject to the limitations set forth below). A feed opening 11 leads into the distribution groove 10. As shown in FIG. 2, this feed opening 11 is connected to a side-plate space 12 filled with operating liquid. Thus, operating liquid can flow into the distribution groove 10 through the feed opening 11. As indicated by arrows 13 in FIG. 2, the operating liquid flows from the distribution groove 10 through the axial gap 14 between the control disk 5 and the rotor hub 9 and into the working space 30 of the compressor where it mixes with the operating liquid forming the liquid ring in the working space. The operating liquid flowing through the axial gap 14 seals the gap.

As shown in FIG. 1, the feed opening 11 is arranged in the area between the end of the suction slot 16 and the start of the pressure slot 17 of the control disk 5 relative to the direction of rotation of the rotor 4 as shown by rotation arrow 15. The suction slot 16 connects the suction chamber with the working chamber; the pressure slot 17 connects the pressure chamber with the working chamber. A blocking element 18, connected to the control disk 5, is provided on the side of the feed opening 11 adjacent to the suction slot 16. The blocking element 18 is designed as a finger and projects radially inward into the distribution groove 10. The finger 18 extends radially up to the rotor shaft 8 and axially over the full depth of the distribution groove 10. The distribution groove is thus virtually completely closed on the side adjacent to the suction slot 16. The pressure differential between the pressure of the operating liquid that enters the feed opening 11 and the pressure in the rotor cells rotating past the suction slot 16 is greatest on this side. Since the distribution groove 10 is completely cut off by the finger 18, the operating liquid flowing through the feed opening 11 into the distribution groove 10 cannot flow directly to the distribution-groove area adjacent to the suction slot 16. Instead, the operating liquid must flow through the distribution groove in the direction indicated by arrows 19 in FIG. 1. As the operating liquid flows along the distribution groove 10, some of the operating liquid also flows radially outward through the axial gap 14 and seals the gap.

Since the pressure differential between the pressure of the operating liquid entering the feed opening and the pressure prevailing in the rotor cells in the area lying toward the pressure slot 17 is smaller in this area(i.e., smaller than the differential with respect to the area lying toward the suction slot 16), the liquid quantity flowing off in this area via the axial gap 14 is likewise smaller so that an adequate liquid quantity for sufficient sealing of the axial gap 14 is available as the operating liquid flows in direction 19 around the distribution groove 10.

What is claimed is:

1. A liquid-ring compressor comprising a compressor housing having a center axis;

a rotor having two end faces, a hub, a plurality of rotor cells, a rotor shaft and an axis of rotation, the rotor being mounted in the compressor housing such that the axis of rotation of the rotor is eccentric to the center axis of the compressor housing;

at least one control disk arranged on one of the end faces of the rotor, the control disk being provided with a suction slot and a pressure slot for the feeding and discharging of the medium to be compressed, respectively, the control disk also having a distribution groove encircling the rotor shaft adjacent to the hub of the rotor, the distribution groove being covered radially by the hub of the rotor, the distribution groove having a feed opening;

operating liquid that is introduced as sealing liquid into the feed opening of the distribution groove, and a blocking element projecting radially into the distribution groove, wherein the blocking element is provided on the side of the feed opening where the pressure differential between the pressure of the operating liquid entering the feed opening and the pressure in the rotor cells is greater.

2. The liquid-ring compressor according to claim 1, wherein the blocking element extends over the full radial extent of the distribution groove.

3. The liquid-ring compressor according to claim 1, wherein the distribution groove directly adjoins the rotor shaft in the radial direction.

4. The liquid ring compressor according to claim 2, wherein the distribution groove directly adjoins the rotor shaft in the radial direction.

5. The liquid-ring compressor according to claim 1, wherein the feed opening is provided between the end of the suction slot and the start of the pressure slot relative to the direction of the rotation of the rotor.

6. The liquid ring compressor according to claim 2, wherein the feed opening is provided between the end of the suction slot and the start of the pressure slot relative to the direction of the rotation of the rotor.

7. The liquid ring compressor according to claim 3, wherein the feed opening is provided between the end of the suction slot and the start of the pressure slot relative to the direction of the rotation of the rotor.

8. A liquid ring compressor comprising:

a housing having two ends and a center axis and enclosing a working chamber;

a rotor provided within the working chamber, the rotor having two end faces, a shaft, a hub, and an axis of rotation, the axis of rotation being arranged eccentrically to the center axis of the housing;

a side plate attached to one end of the housing and enclosing a suction chamber and a pressure chamber;

an intake connection and a pressure connection provided on the housing, the intake connection leading to the suction chamber and the pressure connection leading to the pressure chamber;

at least one control disk attached to the housing adjacent to one end face of the rotor and having a suction slot and a pressure slot, the suction slot connecting the suction chamber to the working chamber and the pressure slot connecting the pressure chamber to the working chamber;

a distribution groove formed in the control disk, encircling the shaft of the rotor and opening towards the hub of the rotor;

an axial gap between the control disk and the rotor hub;

a feed opening located on the control disk and leading into the distribution groove and connecting with a side-plate space, the side-plate space being filled with operating liquid, the operating liquid flowing along the distribution groove and through the axial gap, and a blocking element projecting radially into the distribution groove, wherein the blocking element is provided between the feed opening and the suction slot relative to the direction of rotation of the rotor.

9. The liquid ring compressor according to claim 8, wherein the blocking element extends over the full radial extent of the distribution groove.

* * * * *